United States Patent [19]

Auer et al.

[11] Patent Number: 4,869,513

[45] Date of Patent: Sep. 26, 1989

[54] TOY SHOOTING GALLERY ASSEMBLY

[75] Inventors: Robert T. Auer, East Stroudsburg, Pa.; Richard J. Mayer, Parsippany, N.J.

[73] Assignee: Buddy L Corporation, New York, N.Y.

[21] Appl. No.: 229,236

[22] Filed: Aug. 8, 1988

[51] Int. Cl.[4] ..... A63B 67/00

[52] U.S. Cl. ..... 273/315

[58] Field of Search ..... 273/315, 314

[56] References Cited

U.S. PATENT DOCUMENTS

| | | | |
|---|---|---|---|
| 436,739 | 9/1890 | McIntire | 273/148 R |
| 1,324,189 | 12/1919 | Bremer | 273/315 |
| 3,318,599 | 5/1967 | Zimmerman | 273/315 |
| 4,138,112 | 2/1979 | Lohr | 273/315 |

*Primary Examiner*—Edward M. Coven
*Assistant Examiner*—Benjamin Layno
*Attorney, Agent, or Firm*—Michael Ebert

[57] ABSTRACT

A toy shooting gallery assembly having a raised platform behind whose rear end is an arcuate row of normally erect, pivotally-mounted targets. Each target is provided with a lug that depends from its lower end whereby when this lug is struck, it causes the target to fall down to register a hit. Pivoted at a point adjacent the front end of the platform is a hollow arm on whose front section is mounted a gun having a barrel which extends over the platform, the arm being swingable by the gun in an arc which scans the arcuate row of targets, whereby the barrel may be aimed at a selected target. The gun trigger is operatively coupled by a cable running through the hollow arm to a striker mechanism mounted on the rear section of the arm at a position underlying the target row. When the gun is aimed at a selected target, the striker mechanism is then aligned with the lugs of this target, and when the trigger is pulled by the player, this actuates the striker mechanism to strike the lug, thereby causing the target to fall down to register a hit. No hit is registered when the player's aim is off-target.

8 Claims, 4 Drawing Sheets

10
10R
10B
10F
11
13
14
15
16
17
18
19
19B
20
23
24A
25
25B
26
28
G

TOY SHOOTING GALLERY ASSEMBLY

BACKGROUND OF INVENTION

1. Field of Invention

This invention relates generally to toy shooting galleries, and more particularly to a gallery assembly in which a gun provided with a trigger is operatively linked to a striker mechanism associated with a row of normally-erect targets, such that when the gun is aimed at a selected target by the player and the trigger is pulled, this actuates the striker mechanism to cause this target to fall down to register a hit.

2. Status of Prior Art

Shooting galleries have long been popular, for a gallery affords a protective enclosure in which a player is able to shoot at various targets with a gun. The target is in a form which registers a hit so that the player's hits and misses are scored. Such galleries make it possible for players to develop shooting skills and to compete with other players.

Early forms of shooting galleries, such as those found in amusement parks, provide the player with a rifle chained to a counter placed in front of a target stage. The targets usually take the form of a moving train of duck-shaped plates which are pivotally mounted. If the player aims correctly and strikes a duck plate with a bullet, this causes the plate to tip over, thereby registering a hit.

Because of the obvious hazards involved in using ammunition, in recent years various forms of innocuous guns have been developed for use in shooting galleries, such as motorized water guns which shoot out a stream of water dart guns which shoot out suction cup darts that engage the surface of a target, and guns which project a light or laser beam that is picked up by a light sensor on the target to produce a signal to register a hit (see Bruckner et al. U.S. Pat. No. 4,487,583).

But in all such known guns, the gun must, when triggered, be capable of shooting out a missile of some sort from its barrel or emitting a beam of water or light. These guns are relatively expensive and also easily misplaced, especially by young children. And in some instances, the guns require motors and batteries and include mechanisms which are subject to mechanical or electrical failure.

While existing toy shooting galleries, including those now found in video game arcades which make use of light beam guns and targets provided with light sensors as well as various sound and light effects to indicate a hit, these are unsuitable for very young children in a home environment.

SUMMARY OF INVENTION

In view of the foregoing, the main object of this invention is to provide a toy shooting gallery suitable for young children in which the gun, the targets and the operating mechanisms therefor are all integrated into a compact assembly having no loose components.

A significant advantage of the assembly is that its gun, though it has a barrel that can be pointed toward a selected target, does not actually shoot out anything when the trigger is pulled; yet if the player's aim is correct, the aimed-at target will fall down to register a hit. Thus, the assembly is completely safe in the hands of small children and is incapable of inflicting harm to the player or to objects or bystanders in the vicinity of the gallery. Moreover, since there are no loose parts, no component of the assembly can be misplaced, and the shooting gallery assembly is always in working condition.

More particularly, an object of this invention is to provide an assembly of the above type which includes a row of normally erect targets and a gun that is swingable in an arc to scan the row whereby the gun may be aimed at a selected target and then triggered to cause this target to fall down to register a hit.

Still another object of the invention is to provide an assembly of the above type which can be manufactured at low cost, which is of simple mechanical design and which operates efficiently and reliably, the dimensions of the assembly being such that it may be stored and shipped in a relatively small container.

Briefly stated, these objects are attained in a toy shooting gallery assembly having a raised platform behind whose rear end is an arcuate row of normally erect, pivotally-mounted targets. Each target is provided with a lug that depends from its lower end whereby when this lug is struck, it causes the target to fall down to register a hit. Pivoted at a point adjacent the front end of the platform is a hollow arm on whose front section is mounted a gun having a barrel which extends over the platform, the arm being swingable by the gun in an arc which scans the arcuate row of targets, whereby the barrel may be aimed at a selected target. The gun trigger is operatively coupled by a cable running through the hollow arm to a striker mechanism mounted on the rear section of the arm at a position underlying the target row. When the gun is aimed at a selected target, the striker mechanism is then aligned with the lugs of this target, and when the trigger is pulled by the player, this actuates the striker mechanism to strike the lug, thereby causing the target to fall down to register a hit. No hit is registered when the player's aim is off-target.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figures 1, 6:
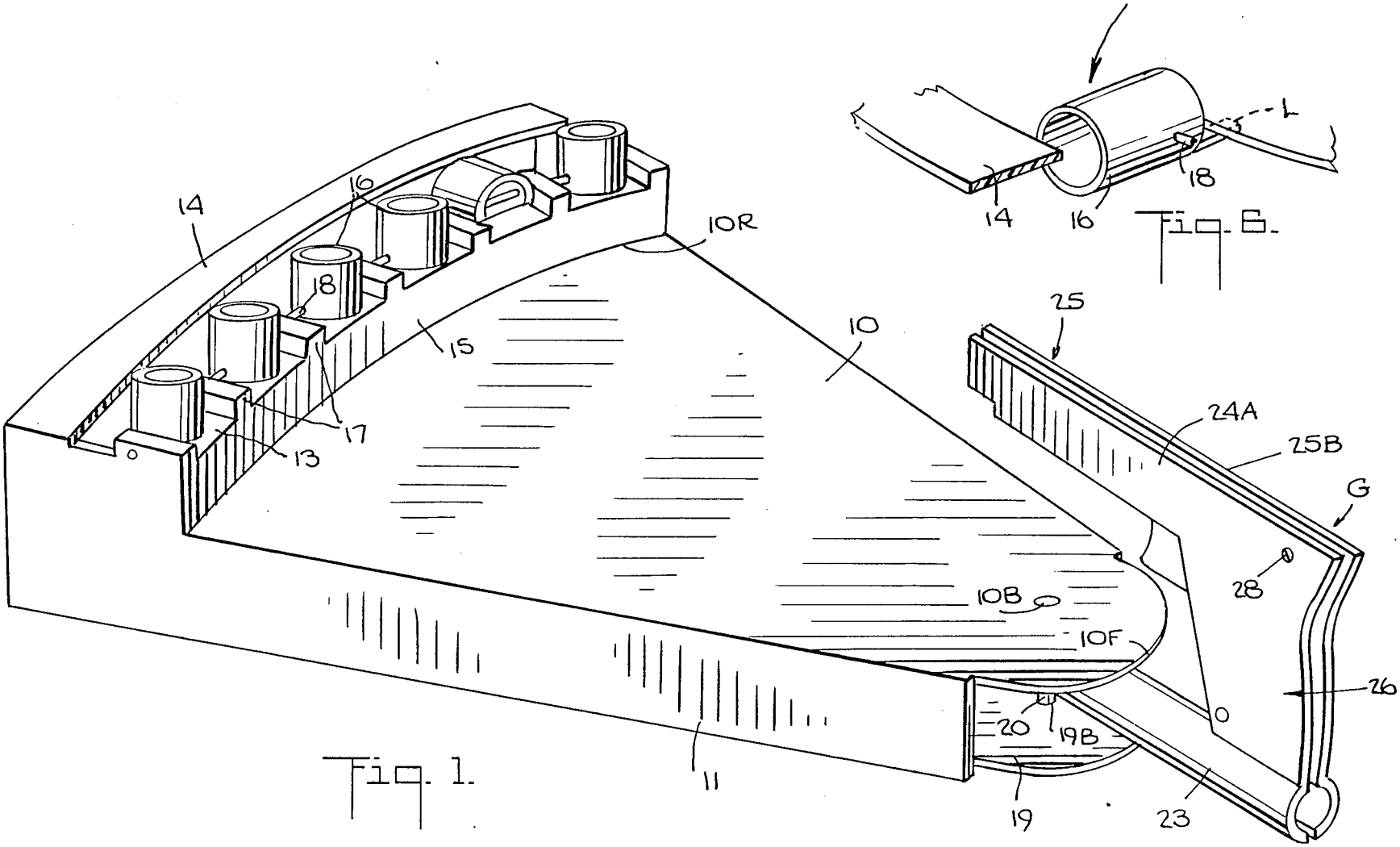
FIG. 1 is a perspective view of a toy shooting gallery assembly in accordance with the invention.
FIG. 6 illustrates a fallen target.
Figure 2:
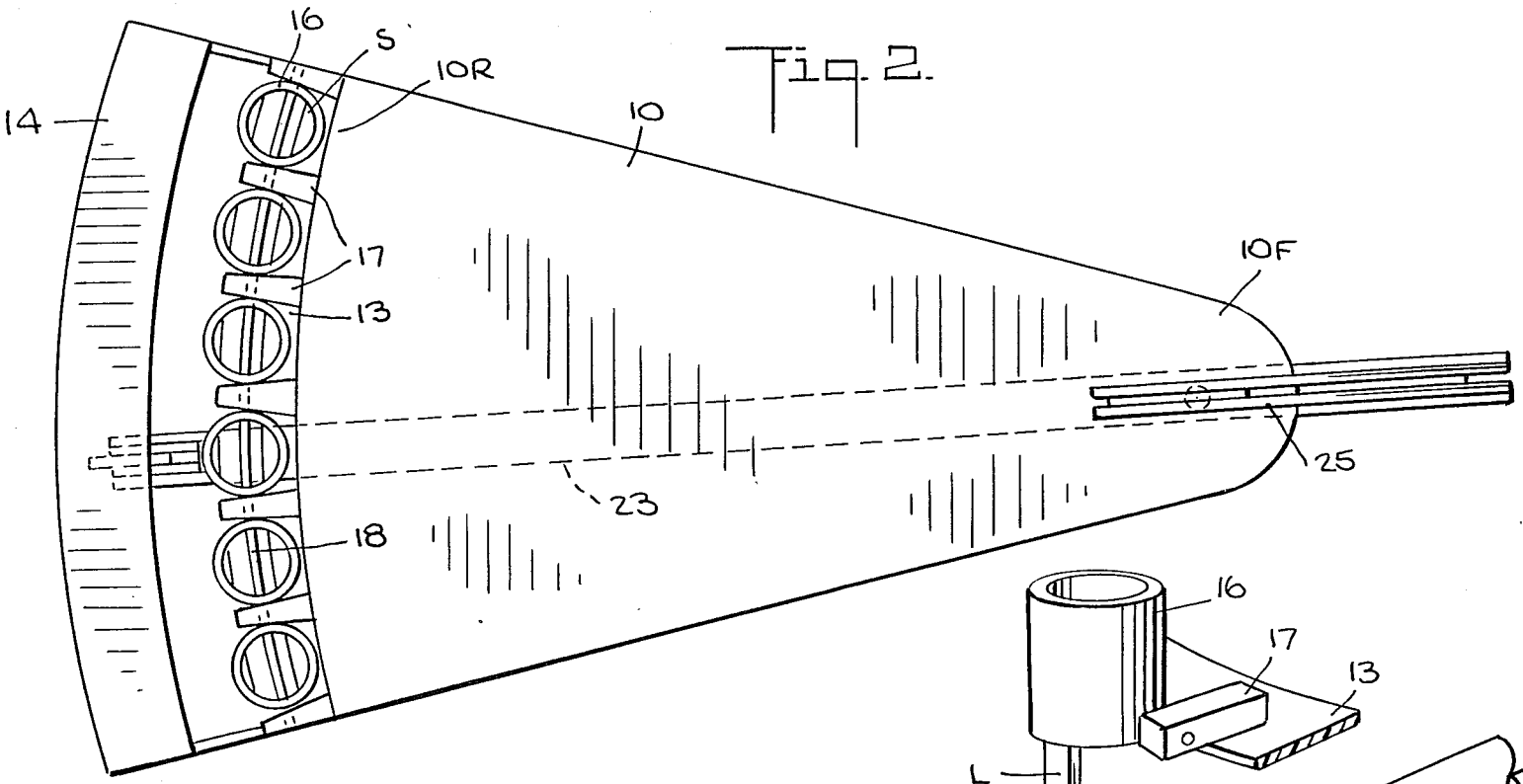
FIG. 2 is a top plan view of the assembly.
Figure 5:
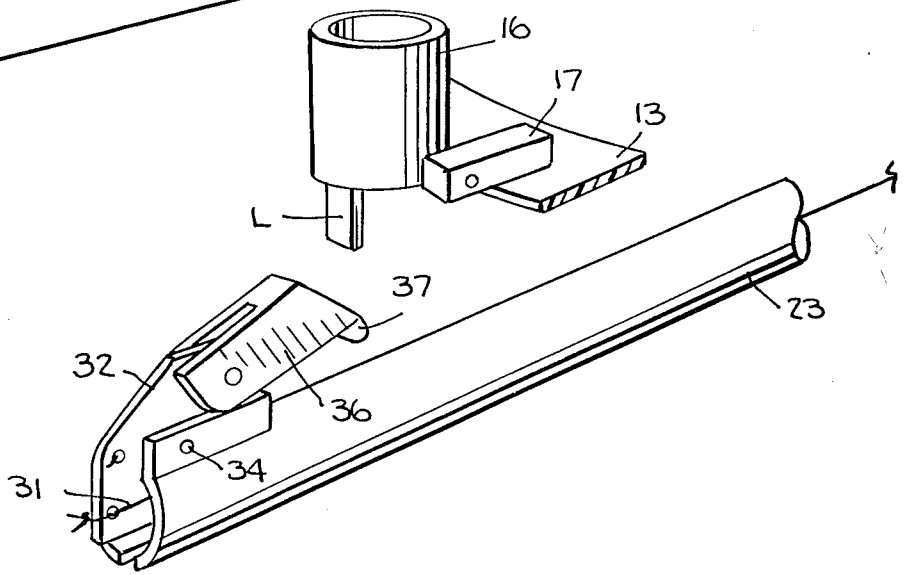
FIG. 5 is a separate view of the striker mechanism for the targets.
Figure 3:
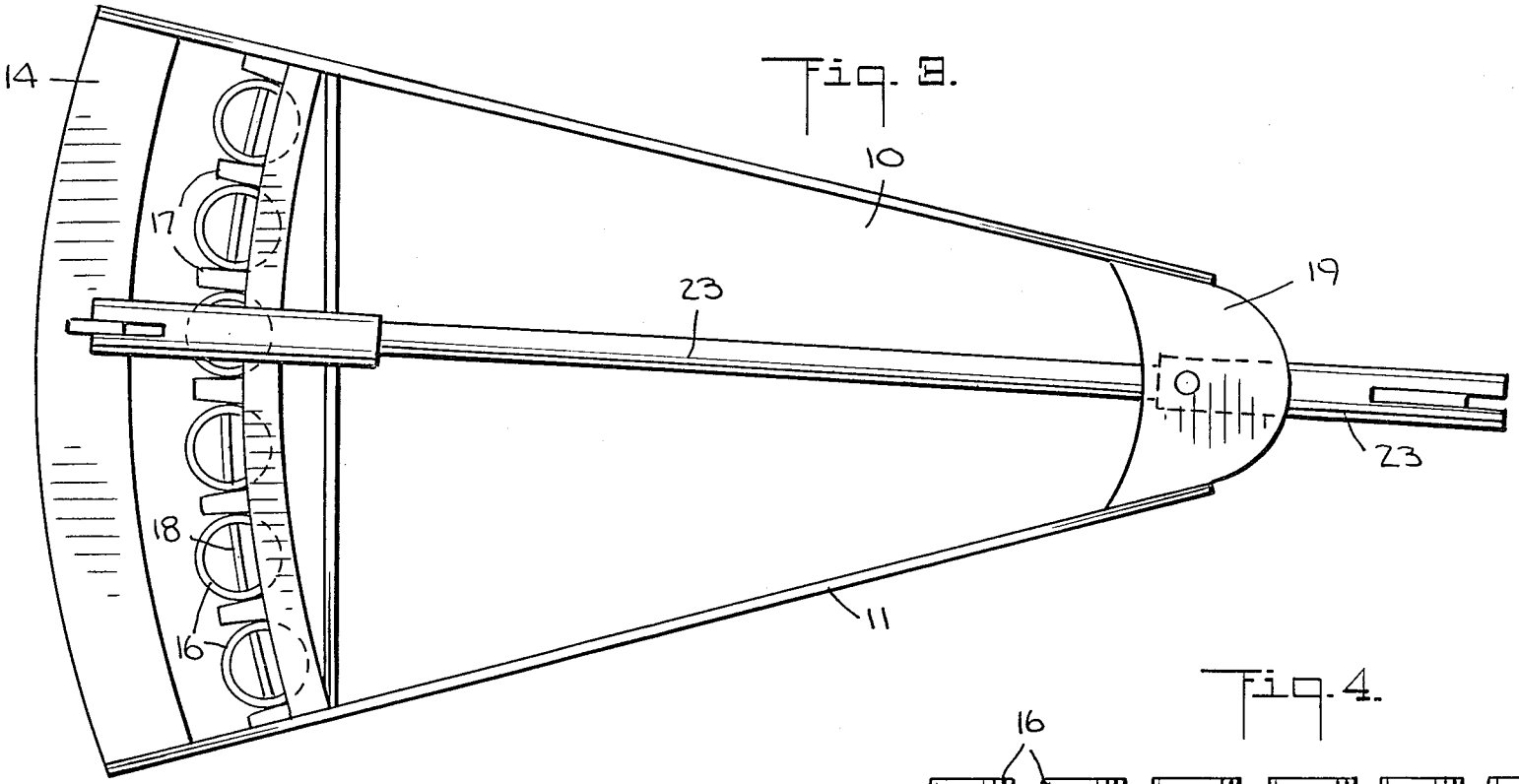
FIG. 3 is a bottom plan view of the assembly.
Figure 4:
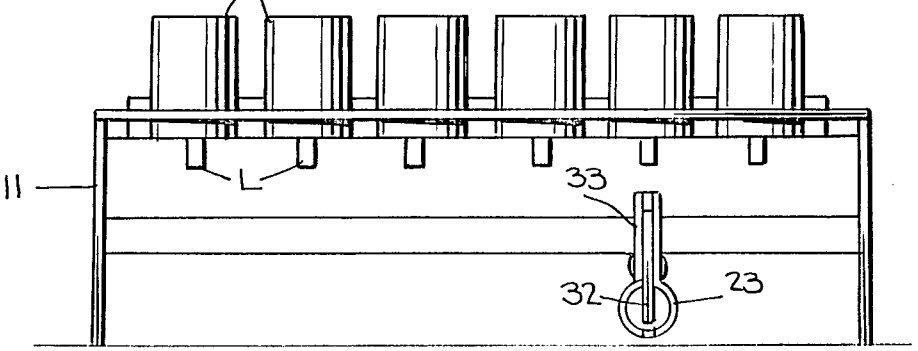
FIG. 4 is an end view thereof.
Figure 7:
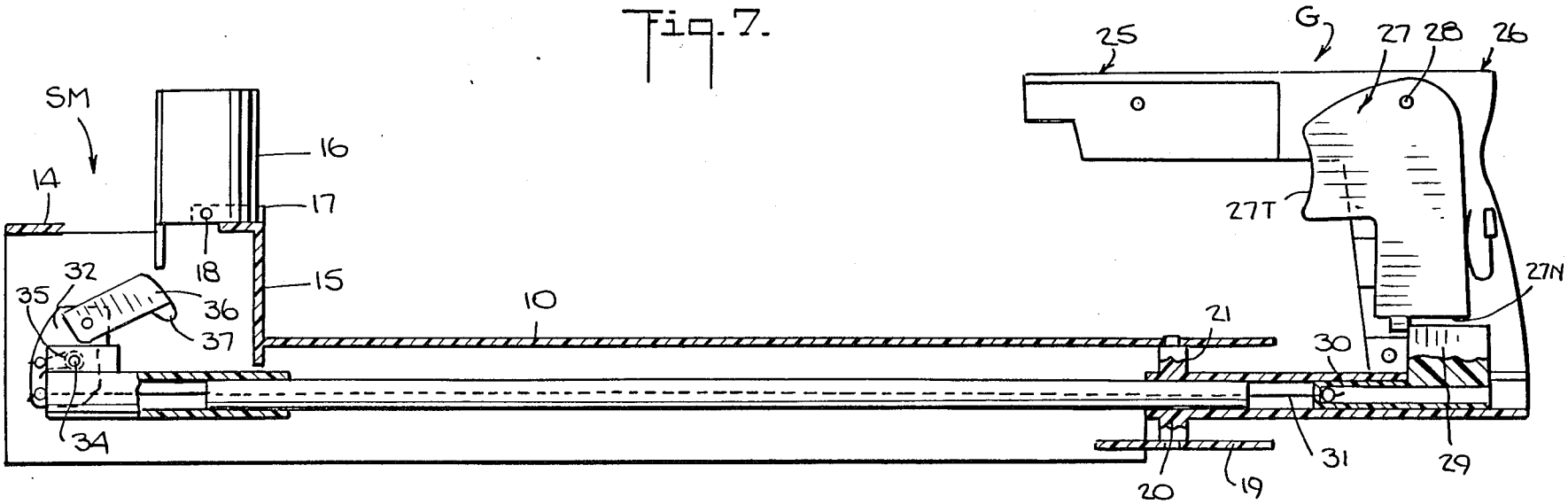
FIG. 7 shows the trigger mechanism of the gun and how it is linked to the striker mechanism for the targets.
Figure 8:
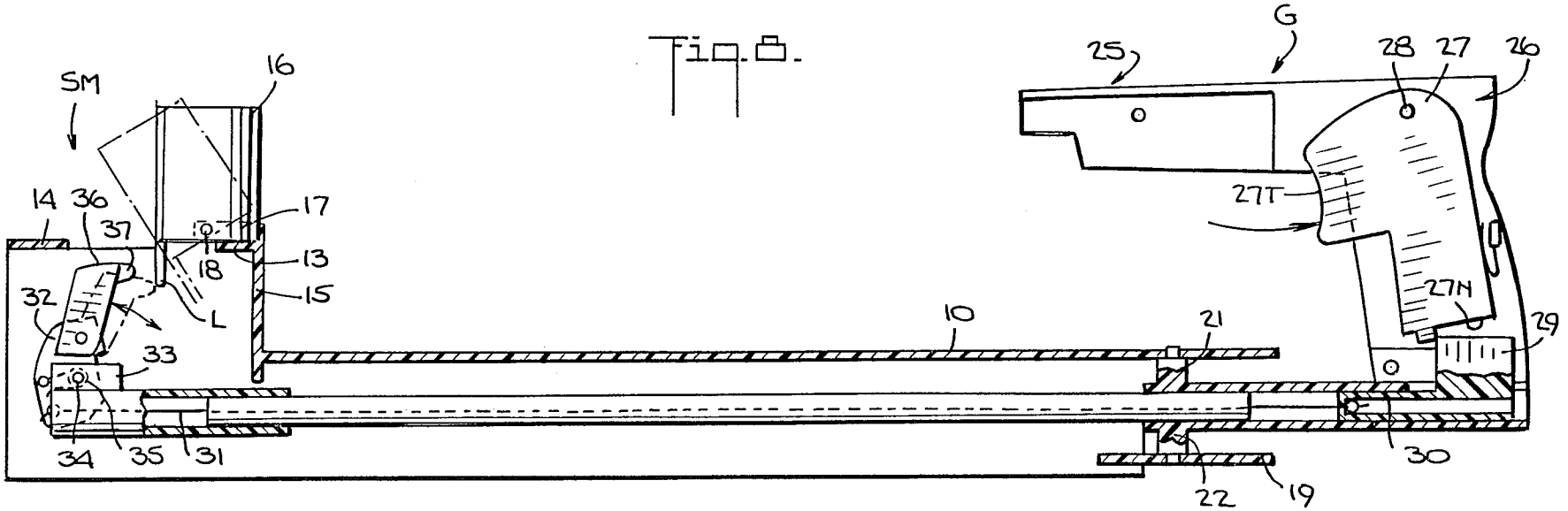
FIG. 8 is the same as FIG. 7 but with the trigger mechanism fired to strike a target.

Referring now to the figures of the drawing, a toy shooting gallery assembly in accordance with the invention includes a fan-shaped platform 10 having an arcuate, wide rear end 10R and a rounded, relatively narrow, front end 10F. Platform 10 is raised above ground level, which in practice may be a table or the floor of a play room, by a pair of side panels 11. Each panel has a square rear section 12 which extends above platform 10 to provide a support for a target stage. This stage is created by an arcuate strip 13 which bridges panels 11 at their upper edges at the front end thereof.

Bridging panels 11 at their upper edges at the rear end thereof is an arcuate cross strip 14 to define a gap between the two strips, strips 13 and 14 being concentric with the arcuate rear end 10R of the platform. Panels 11 are also bridged by a concave vertical wall 15 which is joined to the front edge of stage strip 13 and conforms to the curvature of rear end 10R of the platform.

Resting on stage strip 13 is a row of equi-spaced cylindrical targets 16. Attached to stage strip 13 on either side of the cylindrical targets are bearing blocks 17 having bores therein which register with bores in the targets to receive a curved wire 18 serving to hinge the targets. The wire is displaced from the rear edge of stage strip 13 so that each target can be swung to fall into the gap between stage strip 13 and cross strip 14. Each cylindrical target 16 is provided at its lower end with a lug L which depends therefrom, and with an internal segment S which is positioned against the front wall of the cylinder to lend weight thereto to stabilize the target on the stage.

Bridging side panels 11 at the front end thereof adjacent the lower edge of the panels is a bearing plate 19 having a bore 19B therein which is in vertical alignment with a like bore 10B in the platform. Journaled in these bores are pivot pins 20 and 21 which pivotally support a tubular arm 23 at diametrically-opposed positions thereon, so that the arm is free to swing in an arc which scans the fan-shaped platform.

The front section of arm 23 extends beyond the front end 10F of the platform and mounted on the front section is a gun, generally designated G. Gun G is formed by a pair of vertical plates 24A and 24B contoured to define a gun barrel 25, which projects over the front end of the platform, and a handle 26. Sandwiched between gun plates 24A and 24B is a trigger plate 27 contoured to define a trigger 27T which is outside the gun plates. Trigger plate 27 is pivotally supported by a screw 28 which passes through a bore in trigger plate 27 and joins together gun plates 24A and 24B. Trigger plate 27 is provided at its lower end with a notch 27N adapted to accommodate a finger element 28.

This finger element, when trigger 27T is pulled by a player, engages a tab 29 which extends upwardly through a slot in the front section of tubular arm 23 into the space between parallel gun plates 24A and 24B. Tab 29 is joined to a sleeve 30 which is slidable within the tubular arm.

Attached to sleeve 30 is one end of a cable 31 whose other end is coupled to a striker mechanism, generally designated by the letters SM mounted on the rear end of arm 23 underlying the row of targets. Striker mechanism SM includes a rocker plate 32 sandwiched between a pair of bearing plates 33, rocker plate 32 being pivoted on a screw 34 joining the bearing plates. A spring 35 supported on screw 34 biases rocker plate 32 so that it is normally retracted.

Pivotally attached to the upper end of rocker plate 32 which extends above bearing plates 33 is a striker 36 provided with a nose 37. The other end of cable 31 which passes through the rear end of arm 23 is attached to rocker plate 32; hence when the gun trigger is pulled, this acts through cable 31 to swing rocker plate 32 counterclockwise, and in doing so, to momentarily raise striker 36 to cause its nose 37 to engage lug L of the target then in alignment with the gun. As a result, the pivoted target falls down into the gap between the stage strip and the cross strip.

Thus, to operate the assembly, a player grasping the gun by its handle swings the arm on which the gun is mounted to bring the barrel of the gun in alignment with a selected target on the stage. When the player believes his aim is correct, he then pulls the trigger of the gun; and if in fact his aim is correct, this trigger action causes the nose of the striker mechanism to strike the lug on the selected target and to cause it to fall down, thereby registering a hit.

If, however, the gun aim is off-target, the target will remain erect. If, therefore, in a competitive game each player is given a round of six shots, he can, if his aim is always correct, he can knock down all six targets. But if he succeeds with only four targets, then at the end of the round two targets will remain erect, giving him a score of 4. It is a simple matter at the end of the round for the fallen targets to be raised to their erect position for the next round of play.

While there has been shown and described a preferred embodiment of a toy shooting gallery assembly in accordance with the invention, it will be appreciated that many changes and modifications may be made therein without, however, departing from the essential spirit thereof. Thus in practice, the targets need not be cylindrical and may be in other suitable forms. Also, gongs may be mounted below the target site, so that when a target is struck and falls down, it strikes a related gong or bell to dramatize a hit.

In the shooting gallery arrangement shown in the drawings, the targets are stationary; and while they are adapted to fall down when effectively shot, the targets do not otherwise travel. To lend greater interest to the toy, the targets may be made to move continuously along an arc-shaped track by means of a driven endless chain-type link belt, so that when each moving target reaches the end of the track it drops out of the field of sight and then travels under or over the platform until it reaches the beginning of the track where it reappears.

In this moving target arrangement, those targets which have been caused by the player to fall down are automatically reset or re-erected when carried by the chain under the platform, either by reason of gravity or by means of a resetting cam which engages the targets as they move past the cam.

In this moving target arrangement, the targets may take the form of enemy ships or submarines, and the gun may take the form of a periscope provided with a trigger to fire imaginary torpedoes to shoot down targets seen in the periscope. And the game board, in this instance, may be made to simulate an ocean. Or in another version, the targets may be made to simulate bowling pins, with the triggered gun in the shape of a bowling ball aimed at the bowling pins.

I claim:

1. A toy shooting gallery assembly having no loose parts comprising:

A a raised platform;

B a stage at the rear of the platform having a row of normally erect targets pivotally supported thereon and facing the front of the platform, each target having a depending lug at its lower end which at the erect position of the target is vertical and extends below the stage;

C a hollow arm disposed under the platform and pivotally supported at a point adjacent the front thereof, whereby the arm is swingable in an arc that scans the row of targets;

D a gun mounted on the front end of the arm and provided with a barrel which projects forwardly over the platform whereby a player holding the arm-supported gun may swing it to an angular position at which the barrel is aimed at a selected target, said gun having a pivoted trigger element; and E a normally retracted striker mechanism mounted on the rear end of the arm at a position underlying the row of targets, a force transmitting means comprising a cable having one end coupled to the trigger element and the other end coupled to the striker mechanism whereby when the gun is aimed at a selected erect target, the retracted striker mechanism is aligned with the vertical lug of the selected target; and when the trigger is pulled, the cable moves transmitting a force through the arm to actuate the striker mechanism thereby striking the lug and causing the selected target to fall down to occupy a position at which its lug is no longer in alignment with the striker mechanism.

2. An assembly as set forth in claim 1, wherein said platform is fan shaped and the wide rear thereof has an arcuate form, said row of targets being equi-spaced along an arcuate line concentric with the arcuate rear of the platform.

3. An assembly as set forth in claim 2, wherein said targets are cylindrical and each lug depends from the lower end of the cylindrical target.

4. An assembly as set forth in claim 3, wherein said platform is raised by a pair of side plates, each having a rectangular end section that extends above the rear end of the platform, said stage being defined by an arcuate strip bridging the upper edges of the end sections of the panels at the front end thereof.

5. An assembly as set forth in claim 4, wherein said stage strip is provided with bearing blocks on either sides of the targets and a pivot pin extending through bores in the blocks and corresponding bores in the cylindrical targets to support the targets on the stage.

6. An assembly as set forth in claim 5, further including across strip bridging the upper ends of the end section of the panels at the rear end thereof to define with the stage strip a gap into which the targets fall down when struck.

7. An assembly as set forth in claim 1, wherein said cable extending from the striker mechanism through the arm is attached to a sleeve slidable in the front end of the arm, said sleeve being provided with an upstanding tab that extends through a slot in the arm and is engaged by the trigger element of the gun when the gun is pulled.

8. A toy shooting gallery assembly having no loose parts comprising:

A a raised platform;

B a plurality of normally erect targets pivotally supported at spaced positions behind the rear of the platform and facing the front on the platform, each target having a depending lug at its lower end which is vertical when the target is erect;

C a hollow arm disposed under the platform and pivotally supported at a point adjacent the front thereof, whereby the arm is swingable in an arc that scans the targets;

D a gun mounted on the front end of the arm and provided with a barrel which projects forwardly over the platform whereby a player holding the arm-supported gun may swing it to an angular position at which the barrel is aimed at a selected target, said gun having a pivoted trigger element; and E a normally retracted striker mechanism mounted on the rear end of the arm at a position underlying the targets, a force transmitting means comprising a cable having one end coupled to the trigger element and the other end coupled to the striker mechanism whereby when the gun is aimed at a selected erect target, the retracted striker mechanism is aligned with the then vertical lug of the selected target; and when the trigger is pulled, the cable moves transmitting a force through the arm to actuate the striker mechanism thereby striking the lug and causing the selected target to fall down.

* * * * *